US005437462A

United States Patent [19]

Breeding

[11] Patent Number: 5,437,462

[45] **Date of Patent: * Aug. 1, 1995**

[54] WAGERING GAME

[75] Inventor: John G. Breeding, St. Louis Park, Minn.

[73] Assignee: Shuffle Master, Inc., Eden Prairie, Minn.

[ * ] Notice: The portion of the term of this patent subsequent to Feb. 22, 2011 has been disclaimed.

[21] Appl. No.: 198,368

[22] Filed: Feb. 18, 1994

Related U.S. Application Data

[63] Continuation of Ser. No. 23,196, Feb. 25, 1993, Pat. No. 5,288,081.

[51] Int. Cl.[6] ..... A63F 1/00

[52] U.S. Cl. ..... 273/292; 273/274; 273/309

[58] Field of Search ..... 273/274, 309, 292, 85 CP

[56] References Cited

U.S. PATENT DOCUMENTS 4,651,997 3/1987 Wood ..... 273/292
5,019,973 3/1991 Wilcox et al. ..... 273/85 CP
5,167,413 12/1992 Fulton ..... 273/274

OTHER PUBLICATIONS

Encyclopedia of Games by John Scarne, pp. 33–41, Harper & Row Publishers, 1973.

*Primary Examiner*—Benjamin H. Layno
*Attorney, Agent, or Firm*—Dorsey & Whitney

[57] ABSTRACT

A playing card wagering game method which involves placing a three part bet. Cards are dealt by the dealer, two face down to the dealer and three face down to each player. Players inspect or "sweat" their cards and the dealer asks "take it or leave it?" with regard to one part of the bet. Each player decides and the dealer then turns over one of the cards and again asks "take it or leave it?" with regard to the second part of the bet. The players decide, their cards are shown, and all remaining bets are resolved.

13 Claims, 2 Drawing Sheets

WAGERING GAME

This is a continuation of application Ser. No. 08/023,196, filed Feb. 25, 1993, now U.S. Pat. No. 5,288,081.

TECHNICAL FIELD

The present invention relates to playing card wagering games that can be played with a standard deck of cards or by video machine technology in a casino or home environment. In particular, it relates to a method and apparatus for playing a wagering game, wherein the game is a variation of five stud card poker and provides players the opportunity to take or leave a portion of their wager during the course of the game.

BACKGROUND ART

There are many wagering games used for gambling. Such games should be exciting to arouse players' interest and uncomplicated so they can be understood easily by a large number of players. Ideally, the games should include more than one wagering opportunity during the course of the game, yet be able to be played rapidly to a wager resolving outcome. Exciting play, the opportunity to make more than one wager and rapid wager resolution enhance players' interest and enjoyment because the frequency of betting opportunities and bet resolutions is increased.

Wagering games, particularly those intended primarily for play in casinos, should provide players with a sense of participation and control, the opportunity to make decisions, and reasonable odds of winning, even though the odds favor the casino, house, dealer or banker. The game must also meet the requirements of regulatory agencies.

Wagering games, including wagering games for casino play, with multiple wagering opportunities are known. U.S. Pat. Nos. 4,861,041 and 5,087,405 (both to Jones et al.) disclose methods and apparatus for progressive jackpot gaming, respectively. The former patent discloses that a player may make an additional wager at the beginning of a hand, the outcome of the additional wager being determined by of a predetermined arrangement of cards in the player's hand. U.S. Pat. No. 4,836,553 (to Suttle and Jones) discloses a modified version of a five card stud poker game.

Additional symbols may be added to the usual means of playing a game to increase wagering opportunities. This is disclosed in U.S. Pat. No. 5,098,107 (to Boylan et al.). Somewhat similarly, U.S. Pat. No. 3,667,757 (to Holmberg) discloses a board game and apparatus, including a way to allow the player to make a choice with respect to several different alternative types of game play and risk bearing strategies. The alternative play is based on providing cards with additional symbols and therefore, a new set of odds. The game and apparatus disclosed by Holmberg requires new sets of rules, relatively complicated procedures and time for a player to learn the game.

U.S. Pat. No. 5,154,429 (to LeVasseur) involves the dealer playing multiple hands against a player's single hand, whereby the number of hands played in the same amount of time is increased.

The desired attributes of wagering games outlined above are in large measure provided by the method and apparatus for a wagering game in accordance with the present invention. The game is uncomplicated, exciting and provides the opportunity for players to make multiple wagers and choices regarding those wagers.

SUMMARY OF THE INVENTION

The wagering game of the present invention is played with a single, typical fifty-two card poker deck and broadly involves the generally well recognized and accepted set of rules, procedures and wager-resolving outcomes of five card poker. The game method comprises each player placing an initial, three-part wager to participate in the game. Cards are dealt by a dealer, three down to each player and two down to the dealer. Players inspect or "sweat" their cards, and the dealer asks "take it or leave it?" or "let it ride?" with regard to the first part of the initial bet. Players can choose to retrieve or remove from play the first part of their initial bet, or leave the first part in play or at risk, based on the value of the three cards in their hand. The dealer then turns over one of the dealer's cards and the dealer's query is repeated with regard to the second part of the initial bet. Players can choose to retrieve or remove from play the second part of their initial bet or leave the second part in play or at risk, based on the value of the four cards consisting of the three cards in the player's hand and the exposed dealer's card. Players have no option with the third part of the bet. Finally, all cards are shown and the payouts and collections are resolved according to the ranking of the poker hand of each player, i.e., the players are not playing against each other or the dealer.

More specifically, the initial wager placed by each player comprises three equal parts and is made or placed before any cards are dealt. Each player is dealt three cards face down in the customary fashion. Two common cards are dealt face down in front of the dealer for use by all of the players. Each player will use the two common cards in front of the dealer in combination with his or her three cards to create a five card hand. After all players have placed their bets and received and examined their cards, each is given the opportunity to retrieve one-third of the initial wager before the dealer reveals one of the two down cards previously placed in front of him. After all of the players have been queried and decided whether to "take it or leave it", the dealer turns one of the down cards face up. Each player now has the benefit of four cards, the three he or she is holding down plus the common card, and the dealer again gives each player the opportunity to retrieve one-third of the beginning wager before exposing the second common down card. After the second common down card is revealed, the players turn up the three cards they are holding thereby forming five card hands made up of the three cards dealt to each player and the two dealer cards. The dealer examines each of the players hands and determines what payout, if any, each player is entitled to receive according to that players' remaining wager and a preselected payout schedule. Payouts are made to players with winning hands and the losing wagers are collected. The cards are then reshuffled for the next hand.

Apparatus is disclosed for playing the wagering game according to the method outlined above. A typical gaming table, with a playing surface, is modified to include specific areas that provide locations for placing the wagers and for displaying the common cards. A card shuffling machine such as that disclosed in U.S. Pat. No. 4,807,884 (invented by the inventor of the present invention and commonly owned) for facilitating and speeding the play of the wagering game may be used. A display device may be associated with the apparatus for displaying game information.

It is an object of the present invention to provide an exciting and interesting wagering game. Another object of the present invention is to provide a wagering game that is easy to learn, largely being based on five card stud poker and the well known ranking of poker hands.

It is another object of the present invention to provide a new variation of a well known wagering game, five card poker, which is made interesting by providing the opportunity for players to make multiple wagers and decisions related to those wagers based on the progress of the game.

Still another object of the present invention is to provide a wagering game that is easy to learn, yet demands skill of players in making strategic decisions about whether to let part of their bet ride.

It is yet another object of the present invention to provide a unique, exciting card game for play in casinos or at home and on various media including casino tables, video poker machines, video lottery terminals or home computers.

It is an advantage of the game of the present invention that wagering decisions are inherent in the game. The game enhances players' sense of participation and takes advantage of players'inclination to let wagers ride once placed.

DETAILED DESCRIPTION OF THE PREFERRED EMBODIMENT

Figure 1:
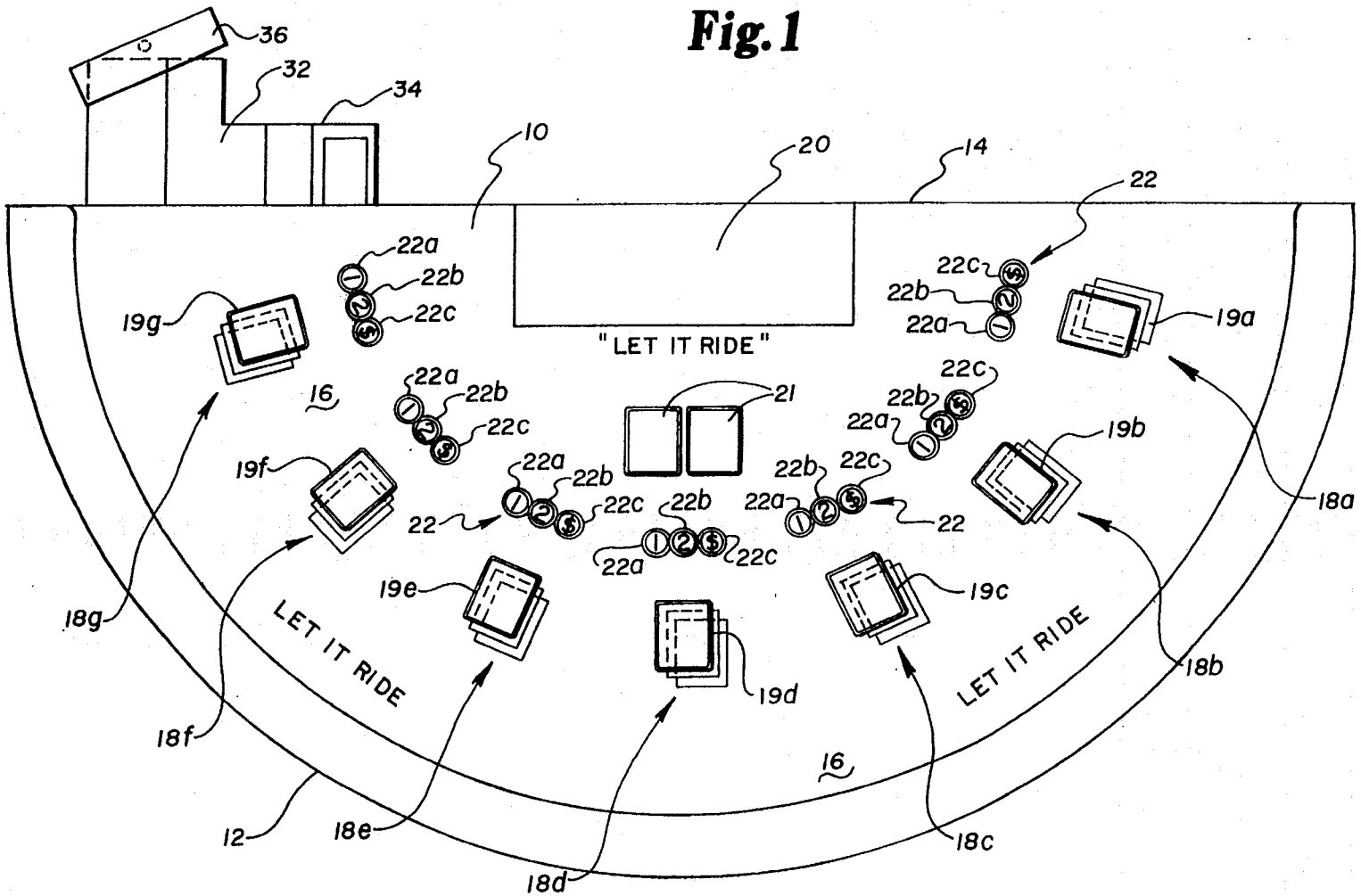
FIG. 1 depicts the table layout and apparatus used in playing the wagering game of the present invention.

Referring to FIG. 1, the apparatus for the wagering game of the present invention includes a typical casino gambling or gaming table 10. The table 10 has a curved side 12 for accommodating up to seven players and a straight side 14 for accommodating the dealer. The table 10 has a flat surface 16 covered with felt or other appropriate material. Although seven playing positions or locations 18*a-g* for individual players are provided, it is not essential to the game that exactly seven persons play and as many as sixteen players may participate. For casino play, a maximum of seven players provides for a game that is easily manageable by the dealer and house, and one in which the individual players feel more involved. A house dealer position 20, including an area suitable for displaying the dealer's cards 21, is provided.

Each of the playing positions 18*a-g* includes a wagering zone 22, comprising three separate and distinct wagering or betting areas 22*a, b, c*. Each position 18*a-g* also includes a card area 19*a-g* for receiving and displaying cards dealt to the player occupying the position. The wagering areas 22*a, b, c* are designed to receive appropriate wagering indicators or settling means such as chips (not shown).

At one side of the dealer station 20, the apparatus for practicing the method of the present invention may include a microprocessor or computer controlled shuffling machine 32 supported by a table extension 34. The shuffling machine 32 may be of the type disclosed in U.S. Pat. No. 4,807,884, the disclosure of which patent is incorporated herein by reference. The shuffling machine 32 may include a dealing module for automatically and sequentially dealing cards and also may include a display means for displaying wager amounts, the identity of winning players, or other game related information.

Figure 2:
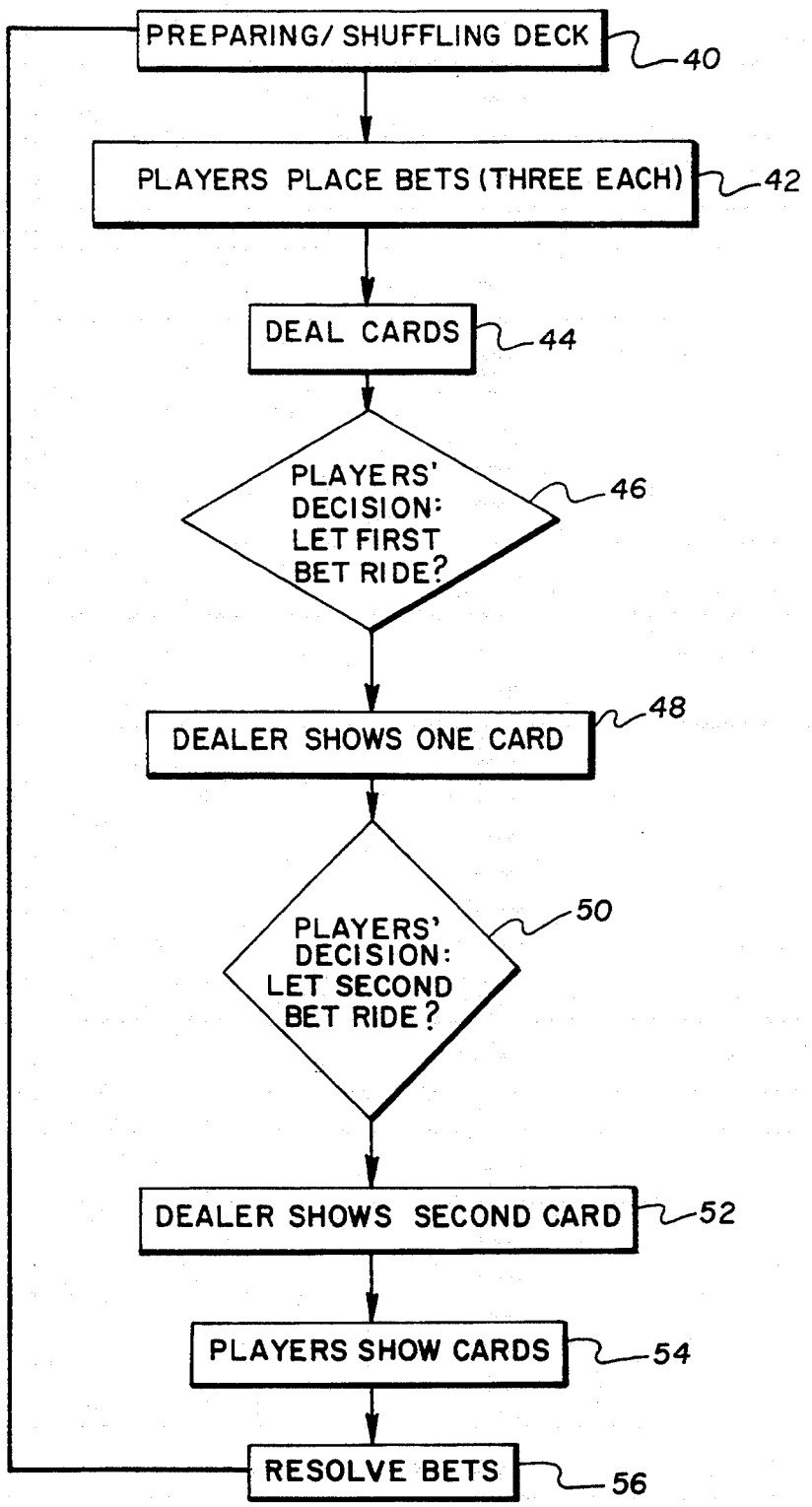
FIG. 2 is a block diagram representing the flow of play in the game.

Referring to the flow diagram of FIG. 2, the initial step in playing the game of the present invention is preparing or shuffling a deck of cards, represented at block 40, by activating the shuffling machine 32 or by hand-shuffling a deck to provide a shuffled deck. Next, the players place the initial wager, block 42, by puffing equal amounts in each of the three betting areas 22*a, b, c*. Two of the parts of this initial wager, the parts placed in wagering area 22*a* and 22*b* are retrievable at the option of the player. The third portion placed in area 22*c* is a nonwithdrawable bet. After the placing of the wager by each player, the cards are dealt, block 44, three cards being dealt down to each player and two cards are dealt down in front of the dealer. The players inspect or "sweat" their cards in preparation for reaching decision block 46. At derision block 46, the players are queried by the dealer about whether the first part of the initial wager, the part placed in wagering area 22*a*, should be left or whether the player wishes to withdraw that portion of the bet. Each player makes the decision at decision block 46 on the basis of the three cards forming the player's incomplete hand at this point. Once each player has been queried and has decided whether or not to let the first portion of the bet ride, and those bets the player chooses to retrieve or remove are physically removed from area 22*a* and returned to the player, the dealer shows one of the down common cards, block 48. Now, each player has four cards to consider, the three cards dealt to that player originally and the single common card showing on the table. Each player must then deride whether to let the second part of the initial wager ride or whether to withdraw it from the game. After each player is queried and decides what to do with regard to the second part of the bet, and those bets to be withdrawn are physically removed from area 22*b* and returned to the player, the dealer reveals the second common down card, as represented at block 52. Each player now has a five card hand comprised of the three cards each player was originally dealt plus the two revealed common cards. The third bet, the bet placed at wagering area 22*c*, is a nonretrievable portion of the initial bet and the flow of the game proceeds to block 54 wherein the players show or reveal their three cards to the dealer. The dealer resolves each player's bet (which includes all three parts, the second and third part or only the third part, depending on the player's choices during play of the hand) based on the five card hand at block 56 and determines what payout, if any, the player is entitled to receive according to the payout schedule at the particular gaming table or casino. Bets on nonwinning hands are collected by the dealer or house. The hand is then over and the flow of the game returns to block 40, preparing and shuffling the deck for a new hand.

The award or payoff is given for each of the optional bets that were allowed to ride to the end of the hand and for the nonwithdrawable part of the bet. A typical pay table would be as follows:

| | |
|---|---|
| Pair, Tens or Better | 1-1 (even money) |
| Two Pairs | 2-1 |
| Three of a Kind | 3-1 |

-continued

| | |
|---|---|
| Straight | 5-1 |
| Flush | 8-1 |
| Full House | 11-1 |
| Four of a Kind | 50-1 |
| Straight Flush | 200-1 |
| Royal Flush | 1,000-1 |

The method of the present invention is not limited to five card poker games, but may be applied or used in other appropriate games such as seven card poker. The method of the present invention does not require a shuffling machine 32, dealing module 33 or a display means 36. However, these facilitate and expedite the play of the game as well as add interest to the game. While the initial wager of the present invention is preferably comprised of three equal bets, the bets do not necessarily have to be equal. While equal bets are essential for casino play, unequal bets may be used in home play, if desired. The wagering game of the present invention might be played live in casinos with a dealer, or in casinos or homes in interactive electronic or video form with automatic coin or betting means receptacles and payout capability, wherein appropriate symbols for cards, wagers or score keeping would be displayed electronically. A "board-type game" suitable for home, dub or casino use may also be provided for practicing the method of the present invention.

The present invention may be embodied in other specific forms without departing from the essential attributes thereof. It is desired that the embodiments described above may be considered in all respects as illustrative, not restrictive, reference being made to the appended claims to indicate the scope of the invention.

What is claimed is:

1. A method of playing a wagering card game using actual or representations of standard face playing cards having a standard rank, said game involving standard poker hand rankings and comprising the steps of:

a player placing a wager to participate in the game;

providing cards for the player;

giving the player the chance to examine the cards received by the player and to withdraw at least part of said wager based on the rank of the player's cards;

showing the player at least one common card, thereby providing a hand for the player, the player's hand comprising said shown at least one common card and the cards the player received; and resolving the player's remaining wager, which was not withdrawn, based on the rank of the player's hand.

2. The method according to claim 1, said wager comprising at least two parts.

3. The method according to claim 2, wherein the quantity of said at least two parts is at least one more than the quantity of said at least one common card.

4. The method according to claim 1, wherein said wager is divided into parts and wherein the number of said parts of said wager that may be withdrawn is equal to the number of said at least one common card.

5. The method according to claim 4, wherein said parts of said wager are equal.

6. A method of playing a wagering card game using actual or electronically generated representations of standard face playing cards having a standard rank, said game involving standard poker hand rankings and comprising the steps of:

a player placing a wager to participate in the game;

providing three cards to the player;

giving the player the chance examine the three cards received by the player and to withdraw part of said wager based on the rank of the player's three cards;

showing the player a first common card;

giving the player another chance to withdraw part of said wager based on the rank of the player's three cards and said first common card;

showing the player a second common card, thereby providing a five card hand for the player, the player's five card hand comprising the first and second common cards and the three cards the player was provided; and resolving the player's remaining wager, which was not withdrawn, based on the ranking of the player's five card hand.

7. The method according to claim 6, wherein said wager is divided into three equal parts and wherein one of said parts may not be withdrawn.

8. The method according to claim 7, wherein the number of parts of said wager that may be withdrawn is equal to the number of said common cards.

9. A method of playing a wagering game with a single, typical fifty-two card poker deck or an electronically generated representation thereof, the cards having standard rank and value, said game involving generally well recognized and accepted five-card poker wager-resolving hand ranking outcomes and comprising the steps of:

a player wagering an initial, three-part wager amount to participate in the game;

providing three cards to the player;

giving the player the chance to inspect the three cards that player received, and giving the player the choice of withdrawing or leaving at risk the first part of the player's initially wagered amount based on the rank and value of the player's three cards;

showing the player a first common card and giving the player the choice of withdrawing or leaving at risk the second part of the player's initially wagered amount based on the rank and value of the player's three cards and the first common card;

showing the player a second common card thereby providing a five card hand for the player, the five card hand comprising the first and second common cards and the three cards the player was dealt; and resolving the remaining third part, the remaining first and third parts, the remaining second and third parts or the three remaining parts of the player's initially wagered amount, which was not withdrawn, based on the poker hand ranking outcome of the player's five card hand.

10. The method according to claim 9, wherein the third part of the initially wagered amount must remain at risk.

11. The method according to claim 9, wherein the player is not playing against another player or against a dealer.

12. The method according to claim 9, wherein the initial three-part wager amount wagered by each participating player comprises three equal parts and is wagered before any cards are dealt.

13. The method according to claim 9 and providing apparatus for playing the wagering game, said apparatus including a playing surface having a wager-receiving area for receiving separately the three parts of participating players' initially wagered amount, a players' cards-receiving area for receiving and showing the three cards dealt to each participating player, and a common card-receiving area for receiving and showing the two common cards.

* * * * *

UNITED STATES PATENT AND TRADEMARK OFFICE

CERTIFICATE OF CORRECTION

PATENT NO. : 5,437,462

DATED : Aug. 1, 1995

INVENTOR(S) : John G. Breeding

It is certified that error appears in the above-indentified patent and that said Letters Patent is hereby corrected as shown below:

On the title page, in the Notice of disclaimer,

"February 22, 2011" should be --February 25, 2013--.

Signed and Sealed this

Twenty-third Day of January, 1996

*Attest:*

Bruce Lehman

BRUCE LEHMAN

*Attesting Officer*

*Commissioner of Patents and Trademarks*